US006990698B2

(12) United States Patent
Wall, Sr.

(10) Patent No.: US 6,990,698 B2
(45) Date of Patent: Jan. 31, 2006

(54) UPS SHIPPABLE ADJUSTABLE ARTICULATING BED

(76) Inventor: Daniel P. Wall, Sr., 2049 Misty Sunrise Trail, Sarasota, FL (US) 34240

( * ) Notice: Subject to any disclaimer, the term of this patent is extended or adjusted under 35 U.S.C. 154(b) by 0 days.

(21) Appl. No.: 10/844,756

(22) Filed: May 12, 2004

(65) Prior Publication Data

US 2005/0251917 A1 Nov. 17, 2005

(51) Int. Cl.
*A61G 7/015* (2006.01)

(52) U.S. Cl. ..... 5/618; 5/620

(58) Field of Classification Search ..... 5/620, 5/613, 616–618

See application file for complete search history.

(56) References Cited

U.S. PATENT DOCUMENTS

| | | | | |
|---|---|---|---|---|
| 3,921,230 A | | 11/1975 | Hanning et al. | |
| 4,381,571 A | | 5/1983 | Elliott | |
| 4,385,410 A | | 5/1983 | Elliott et al. | |
| 4,407,030 A | * | 10/1983 | Elliott | 5/616 |
| 4,685,160 A | * | 8/1987 | Rizzardo | 5/620 |
| 5,063,623 A | | 11/1991 | Bathrick et al. | |
| 5,257,428 A | * | 11/1993 | Carroll et al. | 5/620 |
| 5,425,150 A | | 6/1995 | Palmer, Jr. et al. | |
| 5,438,723 A | * | 8/1995 | Carroll | 5/620 |
| 5,537,701 A | * | 7/1996 | Elliott | 5/617 |
| 5,568,661 A | | 10/1996 | Bathrick et al. | |
| 5,577,280 A | | 11/1996 | Elliott | |
| 5,579,550 A | | 12/1996 | Bathrick et al. | |
| 5,640,730 A | * | 6/1997 | Godette | 5/618 |
| 5,740,568 A | * | 4/1998 | Elliott | 5/620 |
| 5,870,784 A | | 2/1999 | Elliott | |
| 6,006,379 A | * | 12/1999 | Hensley | 5/618 |
| 6,101,647 A | * | 8/2000 | Stroud et al. | 5/618 |
| 6,209,157 B1 | * | 4/2001 | Hensley | 5/618 |
| 6,216,295 B1 | * | 4/2001 | Pearson | 5/618 |
| 6,276,011 B1 | | 8/2001 | Antinori | |
| 6,357,065 B1 | * | 3/2002 | Adams | 5/618 |
| 6,393,641 B1 | * | 5/2002 | Hensley | 5/618 |
| 6,708,358 B2 | * | 3/2004 | Hensley | 5/915 |
| 6,826,793 B2 | * | 12/2004 | Tekulve | 5/618 |
| 2001/0000828 A1 | * | 5/2001 | Hensley | 5/618 |

* cited by examiner

*Primary Examiner*—Robert G. Santos
(74) *Attorney, Agent, or Firm*—Charles J. Prescott

(57) ABSTRACT

An adjustable articulated bed with separate adjustable leg and head/back assemblies which support an articulating mattress. The invention is manufactured in three pieces specifically designed for economical shipping directly to consumers via United Parcel, FedEx or US Postal, and is easily assembled without tools. The appearance of the bed is similar to that of a standard bed box spring or platform foundation and may be assembled and placed on a traditional metal frame, headboard, or footboard with side rails. Optional adjustable height legs are threadably attachable into support brackets connected to the bottom of each assembly to adjust the overall height of the bed. The three sections include a head support assembly with lifting arms pivotally attached to a head lifting frame and a deck panel attached thereatop to elevate the head and upper body; a leg support assembly with lifting arms pivotally attached to a two-part leg lifting frame with deck panels attached thereatop to elevate the legs; and a stationary center section supports the middle or buttocks area of the user. When the motor is attached between the leg and head support assemblies locking the assemblies together, the center section then slides into place therebetween. No tools, pins, clips or snaps are required for assembly.

12 Claims, 12 Drawing Sheets

10
12
14
18
20
22
16
M
10

UPS SHIPPABLE ADJUSTABLE ARTICULATING BED

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to adjustable articulated beds having a deck mattress support surface which will articulate to separately raise the back and the upper and lower legs of a user lying thereatop. More particularly, this invention relates to such an articulated bed which has separable head/back support and leg support assemblies which are connectable together and which are easily separately shippable under conventional UPS and other common carrier shipping size and weight limits for economy.

2. Description of Related Art

Adjustable beds for comfort and therapy are extremely well known and provide support surfaces for a mattress which will incline the back/head of a user to any desired angle and will also separately incline the legs of the user for both comfort and therapeutic purposes. However, these articulated beds include mattress support or deck structure and motor driven power units which, in their assembled form, are extremely heavy and exceed all conventional economical shipping means available and therefore fall into categories of freight shipping costs which are substantially higher in shipping rates.

The substantially higher cost for such an adjustable bed is due, in part, to the high freight and delivery costs. Freight charges can exceed $150 and delivery and assembly costs for each adjustable twin bed, for example, weighing over 170 lbs. requires a two-man delivery team. Such costs can approach the cost of a conventional bed.

The popularity of adjustable beds increased when advertising programs became directed toward consumers with health or sleeping disorders or simply to recline while reading or watching television. Being manufactured primarily in conventional bedding sizes, the ease with which these inclining beds fitted into a bedroom situation greatly increased usage.

The construction of adjustable bed bases has changed very little over the past thirty years. Most adjustable bed bases are constructed with angle iron frames. A linear actuator lift motor is attached to pivotally connected lifting arms which independent raise and lower the head/back portion and segmented leg portions, typically moving about a stationary transverse mid torso or buttocks support area. A plywood or particleboard deck with upholstered padding is attached to the lifting arms and decorative wood or laminate panels are applied to the sides of the exposed metal frame for a finished appearance. However, these additions do not overcome the resemblance to a hospital bed.

The substantially higher cost for such an adjustable bed is due, in part, to the high freight and delivery costs. Freight charges can exceed $150 and delivery and assembly costs for each adjustable twin bed, for example, weighing over 170 lbs. requires a two-man delivery team. Such costs can approach the cost of a conventional bed, over $300.00.

Examples of prior patented adjustable beds are shown in the following U.S. Patents:

| | |
|---|---|
| U.S. Pat. No. 4,381,571 | Elliott, et al. |
| U.S. Pat. No. 4,385,410 | Elliott, et al. |
| U.S. Pat. No. 5,063,623 | Bathrick, et al. |
| U.S. Pat. No. 5,425,150 | Palmer, Jr., et al. |
| U.S. Pat. No. 5,568,661 | Bathrick, et al. |
| U.S. Pat. No. 5,579,550 | Bathrick, et al. |
| U.S. Pat. No. 5,970,784 | Elliott |
| U.S. Pat. No. 6,276,011 | Antinori |

U.S. Pat. No. 4,385,410 to Elliott, et al. discloses an articulated adjustable bed with a single motor which raises the first adjustable section and, through the linkage, the second adjustable section. Another adjustable articulated bed is disclosed by the same inventor in U.S. Pat. No. 5,870,784.

Bathrick, et al. discloses articulated beds in U.S. Pat. Nos. 5,063,623 and 5,568,661. U.S. Pat. No. 5,063,623 is directed to a power module for an articulated bed and the '661 patent is directed to an articulated bed with a modified standard frame supporting an independent power module.

Palmer, Jr., et al., in U.S. Pat. No. 5,425,150, teaches a device for converting a flat bed into an adjustable bed utilizing an articulating platform sandwiched between the box springs and the mattress. In U.S. Pat. No. 6,276,011, Antinori teaches an adjustable bed with a first frame and a second slide frame connected thereon.

To demonstrate the incentive for having a USP shippable adjustable bed, several prior patented efforts have apparently missed that mark.

Elliott, in U.S. Pat. No. 4,381,571 teaches an adjustable articulated bed which may be disassembled for easy shipping in a small container and which is constructed from a minimum number of components. However, this invention teaches an elongated frame member which clearly falls beyond the UPS shipping guidelines for economical category 2 shipment for packages having a weight limit of 70 lbs. and an overall size of less than 130" as the total of length, and girth of the shipping container.

In U.S. Pat. No. 5,579,550, Bathrick teaches an improved articulated bed with linearly retractable head and foot sections for easier shipment in a relatively small container. Bathrick asserts that this articulated bed may be assembled by the purchaser without the need for any tools. By incorporation of telescopic head and foot portions, the Bathrick disclosure teaches size compactness but does not achieve a weight reduction necessary for the economical shipping by UPS.

Elliott has another patented teaching in U.S. Pat. No. 5,577,280 for a snap together adjustable articulated bed. Seven or so components are packaged in three or so separate smaller boxes for easy transport. According to Elliott, these components can be snap fit together in a very complex arrangement of linkages, motor, power carriage, frame, body portion, drag link and lateral rails.

The present invention is specific to the twin extra long size adjustable bed having an assembly length of 80" and a width of 38", the most popular size adjustable bed base in the industry. Two such side-by-side adjustable beds are used to form all king size beds because of the width limitation therefore must remain at 38". The girth of each of the two separate head and leg support assemblies cannot exceed 92" so that the total sum of the length and girth (2×width+2×thickness) of each shipping package does not exceed 130". The leg-lifting section posed the greatest challenge to this limitation of size. To accomplish this size limitation, the present invention by design criteria had to have an overall shipping size, when boxed, of no longer than 39", no thicker than 8" and no wider than 37" wherein the UPS shipping size is calculated to =39"+16"+74"=129". Moreover, the lifting linkages and lifting shafts of each inner lifting frame could not protrude below the plane of the lower margins of the side panels or support legs of each assembly. Otherwise, the lifting linkage could make contact with the support slats of a conventional bed frame.

The present invention incorporates a platform design comprising plywood or particleboard deck panels which are upholstered with fabric and affixed to the lifting frame of each support assembly. The center section is formed of an inanimate central deck panel and side panels so that the three-piece design consisting of a head support assembly, a leg support assembly and a central stationary section are all individually shippable under UPS category oversize 2 limits.

BRIEF SUMMARY OF THE INVENTION

This invention is directed to an adjustable articulated bed with separate adjustable leg and head/back assemblies which support an articulating mattress. The invention is manufactured in three pieces specifically designed for economical shipping directly to consumers via United Parcel, FedEx or US Postal, and is easily assembled without tools. The appearance of the bed is similar to that of a standard bed box spring or platform foundation and may be assembled and placed on a traditional metal frame, headboard, or footboard with side rails. Optional adjustable height legs, which eliminate the need for the traditional metal frame, are threadably attachable into support brackets connected to the bottom of each assembly to adjust the overall height of the bed and to render it as a stand-alone unit. The three sections include a head support assembly with lifting arms pivotally attached to a head lifting frame and a deck panel attached thereatop to elevate the head and upper body; a leg support assembly with lifting arms pivotally attached to a two-part leg lifting frame with deck panels attached thereatop to elevate the legs; and a stationary center section supports the middle or buttocks area of the user. When the motor is attached between the leg and head support assemblies locking the assemblies together, the center section then slides into place therebetween. No tools, pins, clips or snaps are required for assembly.

It is therefore an object of this invention to provide a UPS shippable bed which may be shipped under UPS oversize category 2 size and weight limits for economy.

It is another object of this invention to provide an adjustable bed having the appearance of a conventional box spring-type bed and which is supported atop a standard metal bed frame.

Still another object of this invention is to provide a UPS shippable adjustable bed which is fully articulating by industry standards and which will easily and economically be shipped in three separate boxes directly to the consumer.

Yet another object of this invention is to provide a UPS shippable adjustable bed which is easily assemblable by the consumer without the need for tools.

Still another object of this invention is to allow one man to carry and deliver an adjustable bed around narrow corners, narrow stairways, spiral staircases and narrow hallways of a consumer's home.

Yet another object of this invention is convenient serviceability of assemblies, avoiding the traditional adjustable bed's requirement of in-home service by a service technician, the present invention being serviceable with the shipment of new parts or assemblies directly to the consumer.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
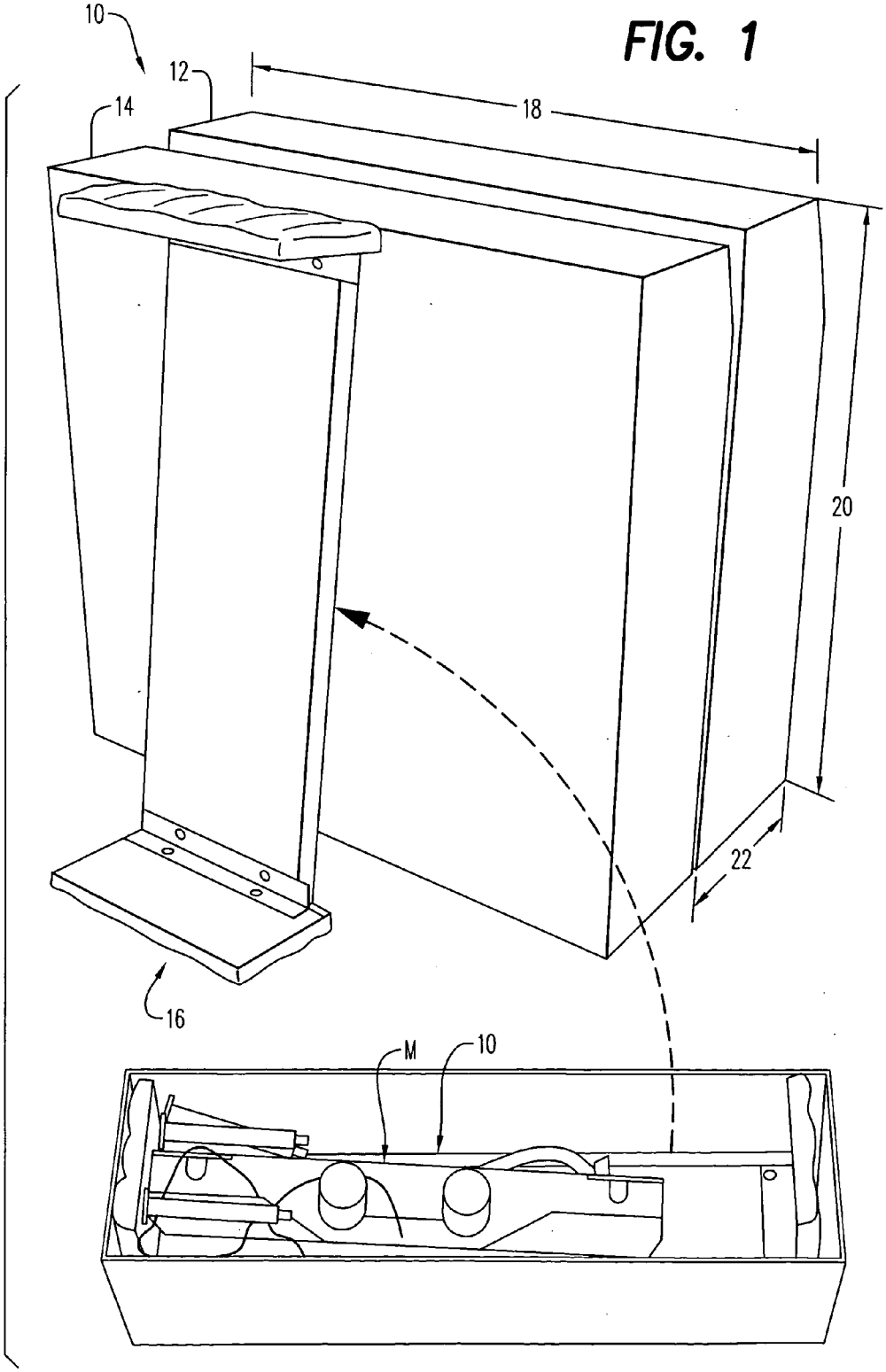
FIG. 1 is a perspective view of the leg lifting assembly and back/head lifting assembly in their shipping containers with the central section also shown unpacked.

Referring now to the drawings, and firstly to FIG. 1, the invention is there shown generally at numeral 10. The invention 10, in partially packaged configuration, includes a packaged ready-to-ship head/back support assembly 12 and a packaged ready-to-ship leg support assembly 14. The invention 10 also includes a stationary center section 16 shown unpackaged. These packages 12 and 14 are preferably of equal size. The motor assembly M, which is provided by an independent manufacturer, is shipped in a container with center section 16.

UPS SHIPPING LIMITS

UPS oversize category #1 limits packages weighing under 30 lbs. and having a length added to girth of less than 108 inches. This category could not be achieved with the invention. However, oversize category #2 packages can weigh up to 70 lbs. and have a length added to girth of up to 130". This is the most economical shipping mode for the invention. UPS oversize category #3 packages, that which is now typically used for adjustable articulated beds, must be over 70 lbs. but less than 90 lbs. and have a length added to girth of box over 130" but less than 165".

The importance of UPS oversize #2 category is illustrated as follows:

EXAMPLE

Five category #2 boxes will ship from Sarasota, Fla. to Knoxville, Tenn. at a cost of $123. The same shipment under UPS oversize category #3 would ship at a cost of $527, a difference of $404, over three times the shipping cost of oversize category #2.

As for the present invention, according to UPS category oversize #2 shipping requirements, each of these packages 12 and 14 cannot weigh more than 70 lbs. and cannot include a length of package, added to a girth of package of more than 130". The length of the shipping package is here defined as the longest side 18 of the packages 12 and 14. As described in the Background, the length of 18 of each of these shipping containers 12 and 14 will typically be established at 39", being the traditional width of a 38" wide twin size bed, adding 1" of package thickness, totaling 39" in length. The girth is here defined as being equal or to the distance around the packages 12 and 14 perpendicular to length 18 or twice the sum of 20 and 22 when added together. The design criteria of the present invention has established the thickness 22 of each of these packaged assemblies 12 and 14 to be 8" while the width 20 of the packaged assembly has been determined by the uniqueness of the invention to be no more than approximately 37". Therefore, length 18=39" added to girth (20 and 22 doubled) equals 90", for a total of 129", just under the oversize #2 UPS maximum 130". Moreover, as will be made clear herebelow, the simplicity of the lifting mechanisms of the present invention facilitates a weight of approximately 65 lbs., well below the maximum overall limit of 70 lbs.

Figure 2:
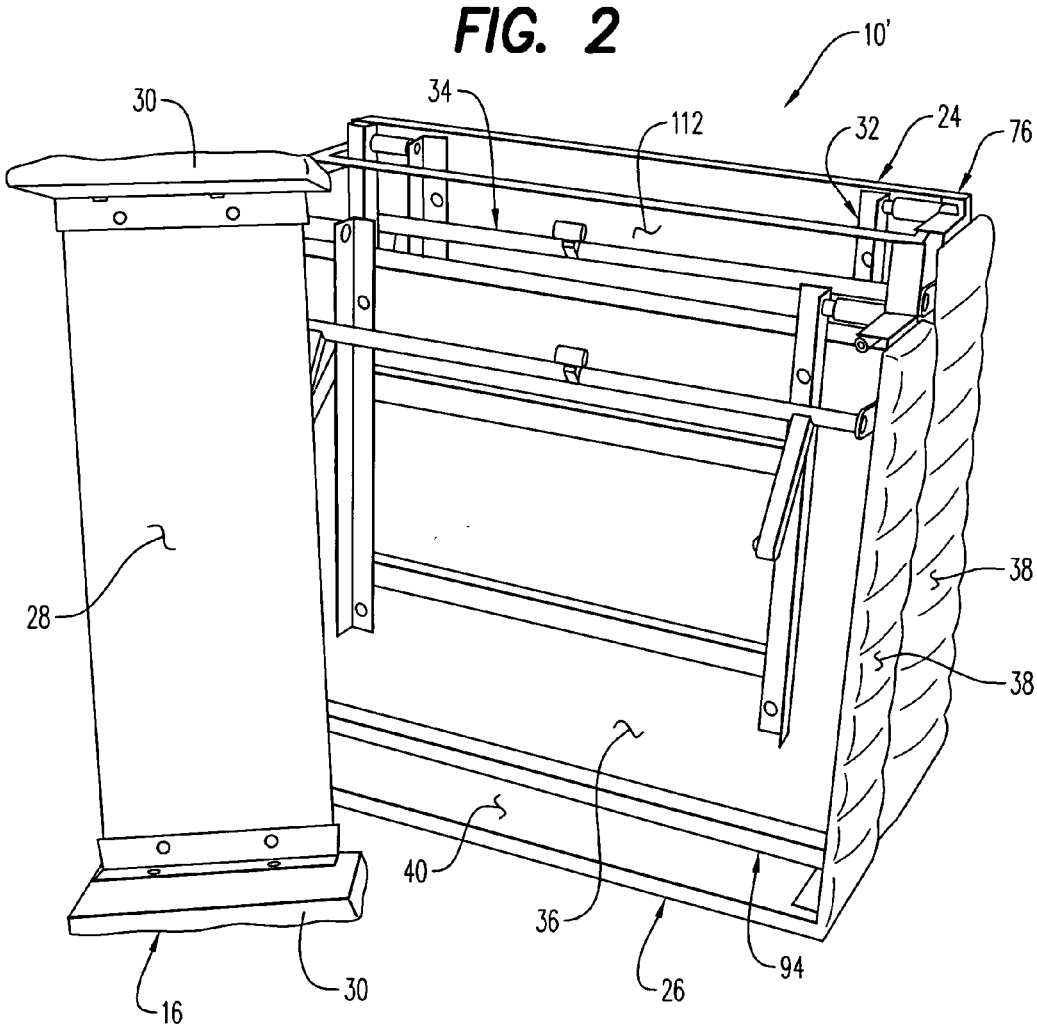
FIG. 2 is a view similar to that of FIG. 1 fully unpacked.

Referring now to FIG. 2, the invention is there shown unpackaged at 10'. The invention 10' includes a leg support assembly 24 and a back/head support assembly 26 (hereinafter referred to as the "head" assembly), and a stationary center section 16. The stationary center section 16 includes a central deck panel 28 which is constructed of a plywood support panel covered atop the upper surface by suitable upholstery materials. Likewise, downwardly extending side panels 30 are also formed of a plywood support panel covered by decorative upholstery material to have the outward appearance of a conventional box spring.

Figure 11:
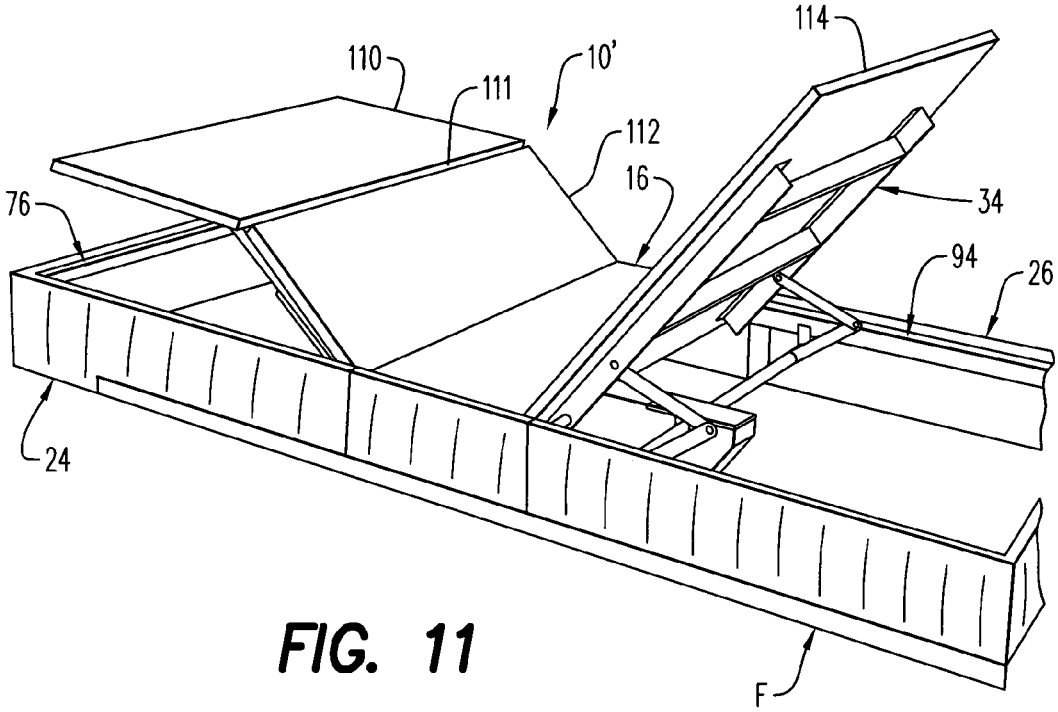
FIG. 11 is a view of the invention in its fully assembled configuration and showing the lifting frames in an upper orientation.

The leg support assembly 24 includes a stationary perimeter frame 76 and a leg lifting frame 32 having hinged at 111 deck panels 110 and 112 best seen in FIG. 11 formed of plywood support panels covered with an upholstery arrangement of choice. Side panels 38 and end panels 40 are also formed of plywood panels having an upholstered outer surface simulating the appearance of a conventional box spring mattress. The head support assembly 26 also includes a stationary frame 94 and a lifting frame assembly 34, also having an upholstered deck panel 36 all of which will be described in detail herebelow.

Figure 5:
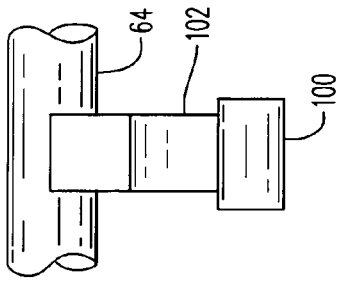
FIG. 5 is an end view of FIG. 4.
Figure 4:
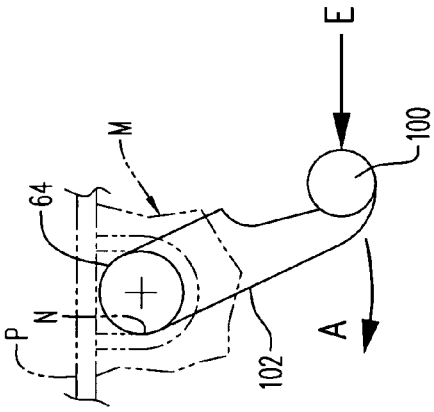
FIG. 4 is an enlarged side elevation view of the actuating lever and actuating shaft of each of the lifting assemblies.
Figure 3:
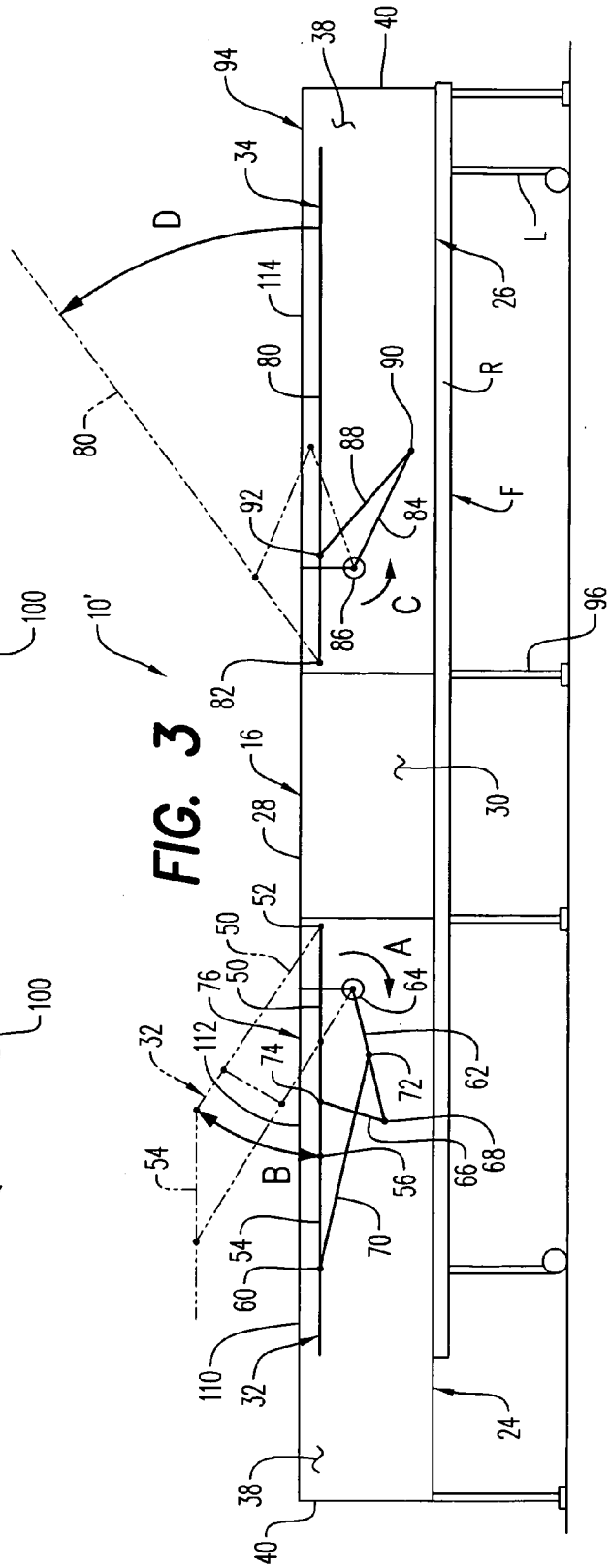
FIG. 3 is a simplified side elevation schematic view of the assembled invention.

Referring now to FIGS. 3 to 5, the invention 10' is shown in FIG. 3 schematically to show the components and articulation of each of the leg support and head support assemblies 24 and 26, respectively. Each of the assembly components 16, 24 and 26 are sized in collective assembled length and width to fit on and be supported by a conventional metal bed frame assembly F which includes longitudinal angle iron rails R and support legs L.

The leg support assembly 24 generally includes a stationary frame 76 forming a rigid rectangular perimeter and a leg lifting frame 32 for the legs and feet. An actuating shaft 64 extends transversely across the central portion of the stationary frame 76 and is there held for rotation only. An actuating arm 62 is rigidly connected at a proximal end thereof to the actuating shaft 64. Two pairs of spaced lifting arms 50 and 54 are pivotally connected together at 56, the other end of lifting arm 50 being pivotally connected at 52 to the stationary frame 76. As a general note, all pivotal axes referred to herein are transverse to the overall longitudinal length of the adjustable bed 10'.

The distal end 68 of actuating arm 62 is pivotally connected to a rigid link 66 which is pivotally connected at the other end thereof at 74 to a mid point of lifting arm 50. Another rigid link 70 is pivotally connected at 72 to a mid point of lifting arm 62, while the other end thereof is pivotally connected to lifting arm 54 at 60. By this arrangement, the entire leg lifting frame 32 is pivoted and articulates to a typical elevated position shown in phantom wherein the actuating shaft 64 is rotated by a motor (described herebelow) in the direction of arrow A causing lifting arms 50 and 54 to articulate upwardly in the direction of arrow B.

Still referring to FIG. 3, the head lifting frame 34 of the head support assembly 26 also includes a transversely oriented actuating shaft 86 which is held for rotation only within the stationary frame 94. Included in the head lifting frame 34 is a pair of lifting arms 80 each of which is pivotally connected about transverse axis 82 to the proximal or central portion of the stationary frame 94. A rigid link 84 is pivotally connected at one end to the actuating shaft 87 while the other end thereof at 90 is pivotally connected to another rigid link 88 which is pivotally connected at its other end 92 to a mid portion along the lifting arm 80. By this arrangement, when the actuating shaft 86 is rotated in the direction of arrow C, the head lifting arm 80 is rotated upwardly into any selected in-use position in the direction of arrow D.

Figure 6:
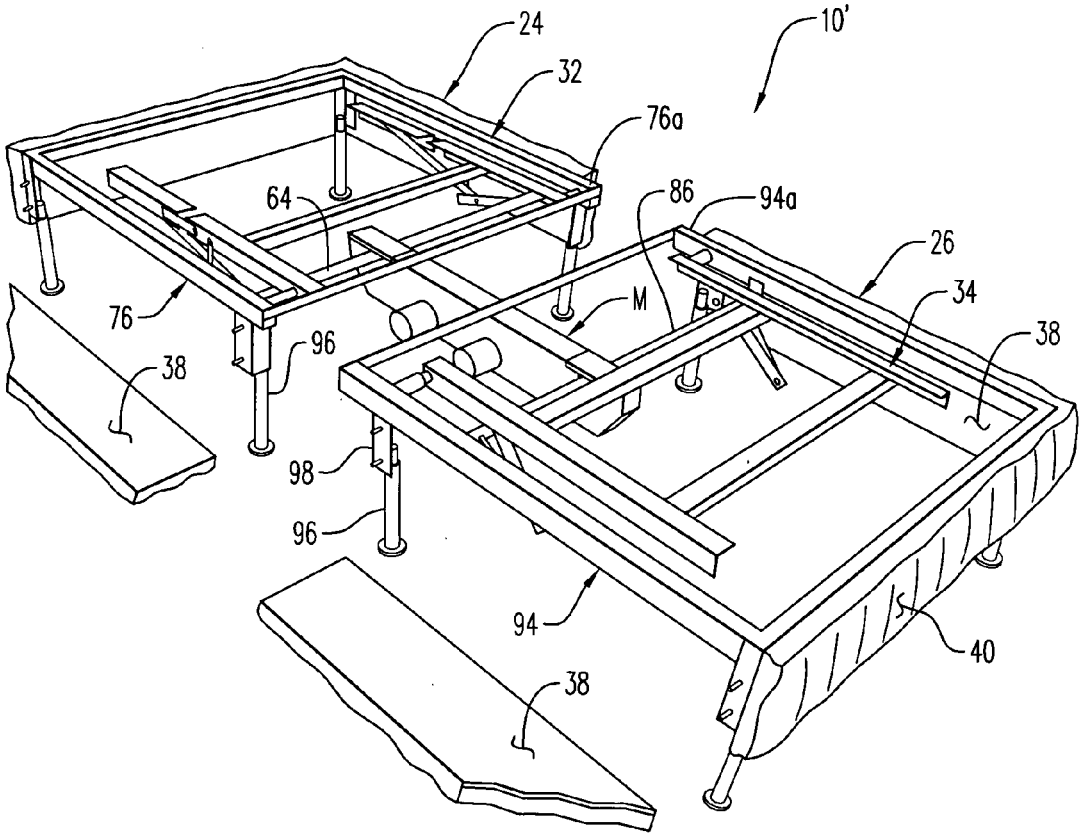
FIG. 6 is a perspective view of the invention in a partially assembled configuration.
Figure 10:
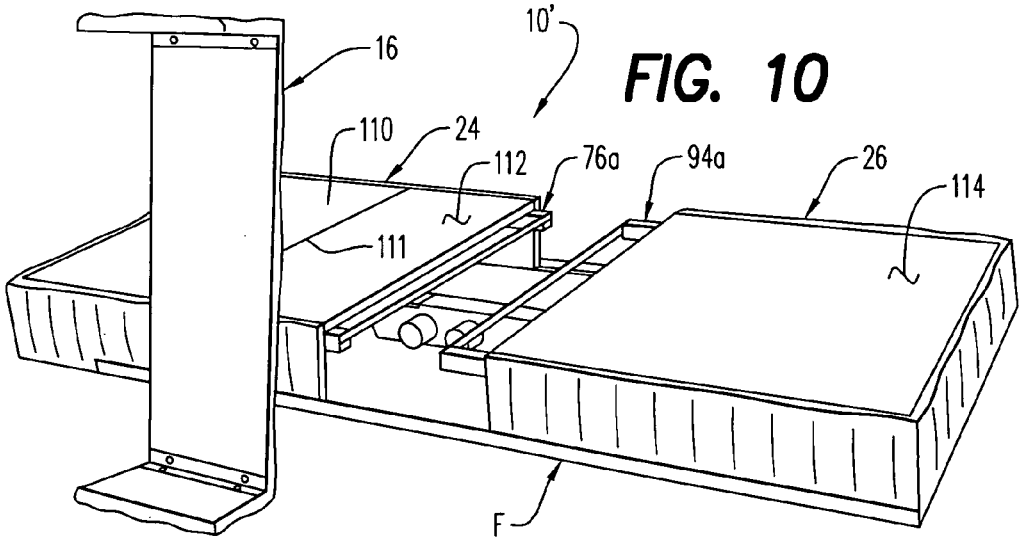
FIG. 10 is a view of the invention also showing the head and leg deck panels in position.

To preferably render the invention to have the appearance of a conventional box spring mattress, the upholstered side panels 38 and end panels 40 are attached by mechanical fastener means shown in the figures to the outer surfaces of the stationary frames 76 and 94. These side panels 38 may also provide the bearing surface along the lower margins thereof for support within the side rails R of the bed frame F. The stationary center section 16 is also partially supported by its end panels 30 within and against the central portion of each of the side rails R and fit against and between each of the support assemblies 24 and 26. Support for the center section 16 is primarily provided by the central ends 76*a* and 94*a* of stationary frames 76 and 94 as seen in FIGS. 6, 10 and 14. When optional legs are attached, stationary center section 16 is supported by support assemblies 24 and 26.

Referring now to FIGS. 4 and 5, each of the actuating shafts 64 and 84 (not shown) include an actuating lever 100 held spaced from the center of rotation of the actuating shaft 64 by arm 102. The motor M, of conventional well known design available as will be described herebelow, causes the powered rotation of the actuator lever 100 by causing movement in the direction of arrow E and thus rotation in the direction of arrow A.

Figure 16:
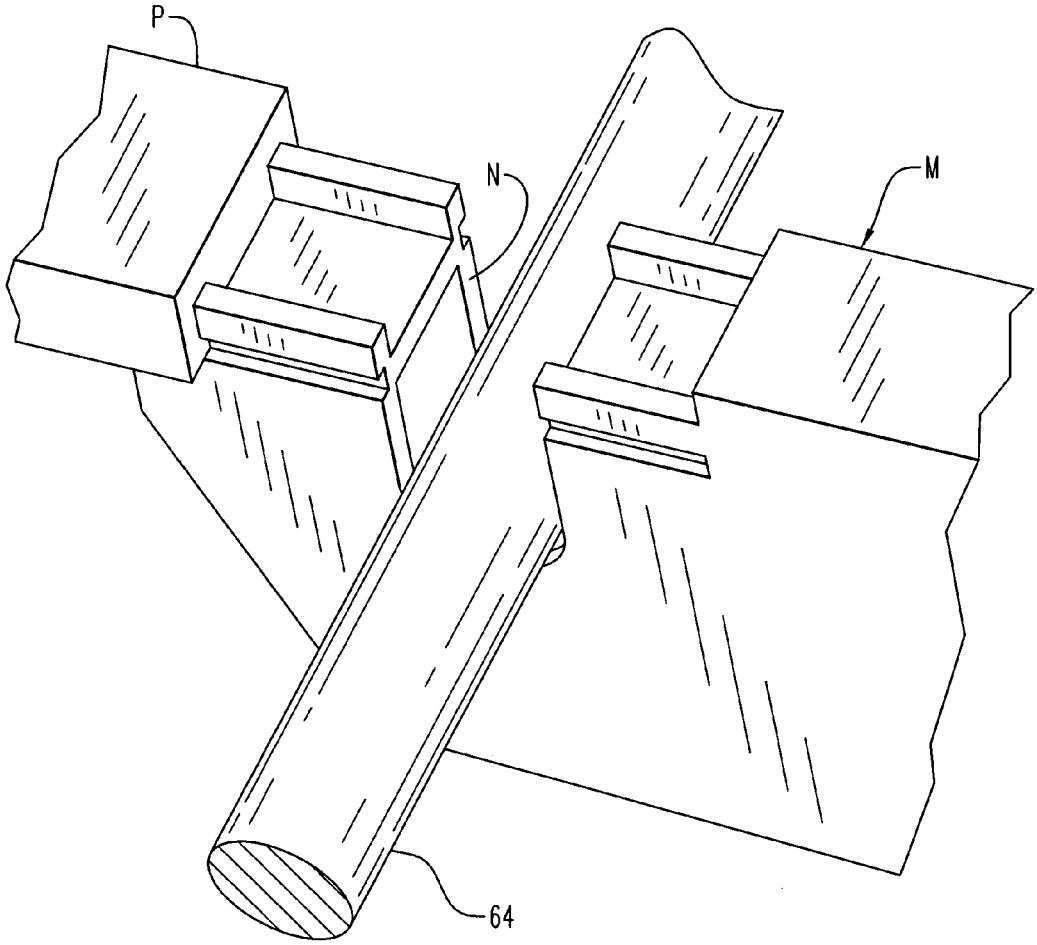
FIG. 16 is an enlarged perspective view of one end of the motor assembly in engagement with one of the actuating shafts of one of the lifting mechanisms.
Figure 17:
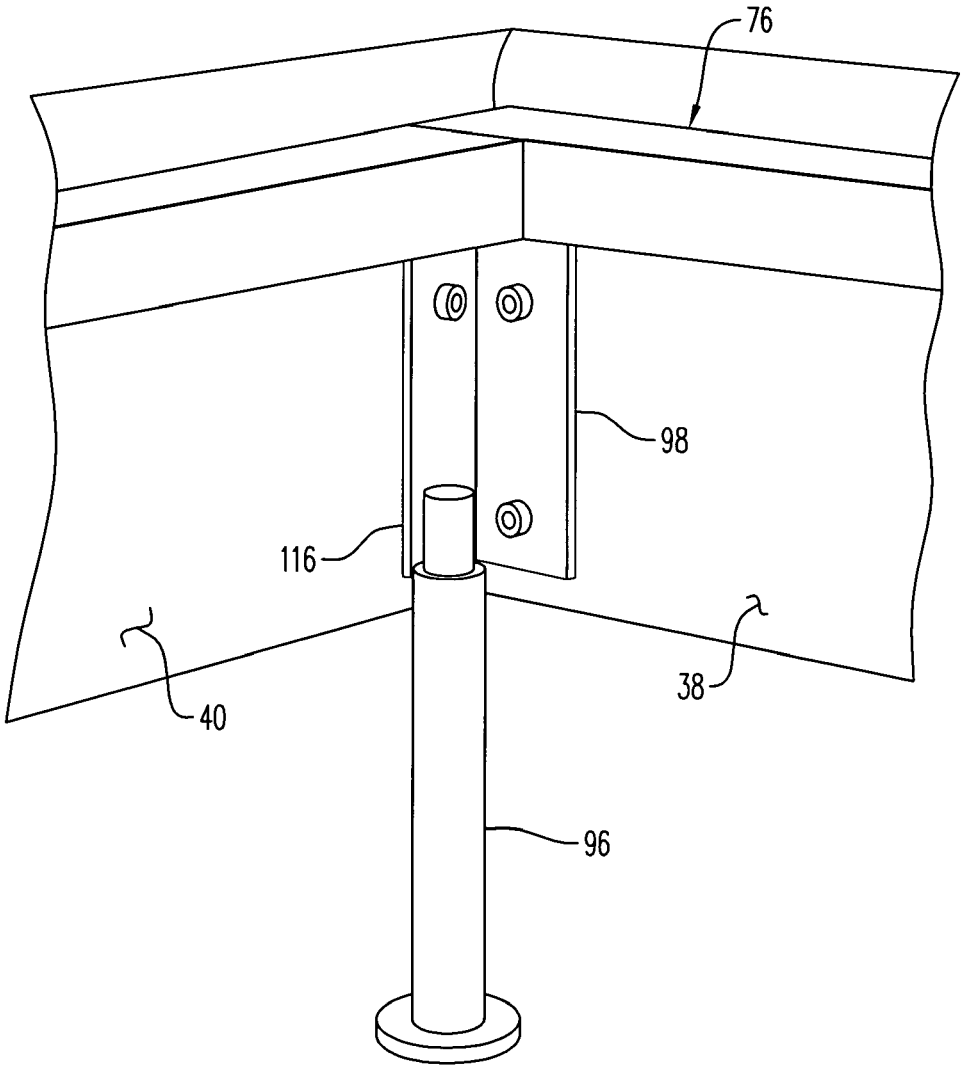
FIG. 17 is an enlarged view of one of the moveable leg supports of the invention.

In FIG. 6, the invention 10' is there shown partially assembled. The motor M has been attached to each of the actuating shafts 64 and 86 and all but two of the side panels 38 have been attached to the stationary frames 76 and 94. Note that the motor M and the access slots N in FIGS. 4, 15 and 16 for receiving each of the actuator shafts 64 and 86 will establish a proper spacing between each of the support assemblies 24 and 26 so as to properly receive the stationary center section 16. Note further that removable legs 96 which threadably engage into a support collar 116 as seen in FIG. 17 welded to corner angle plate 98 may be used in lieu of, or in addition to, the conventional bed frame F for properly supporting the adjustable bed 10'.

Figure 7:
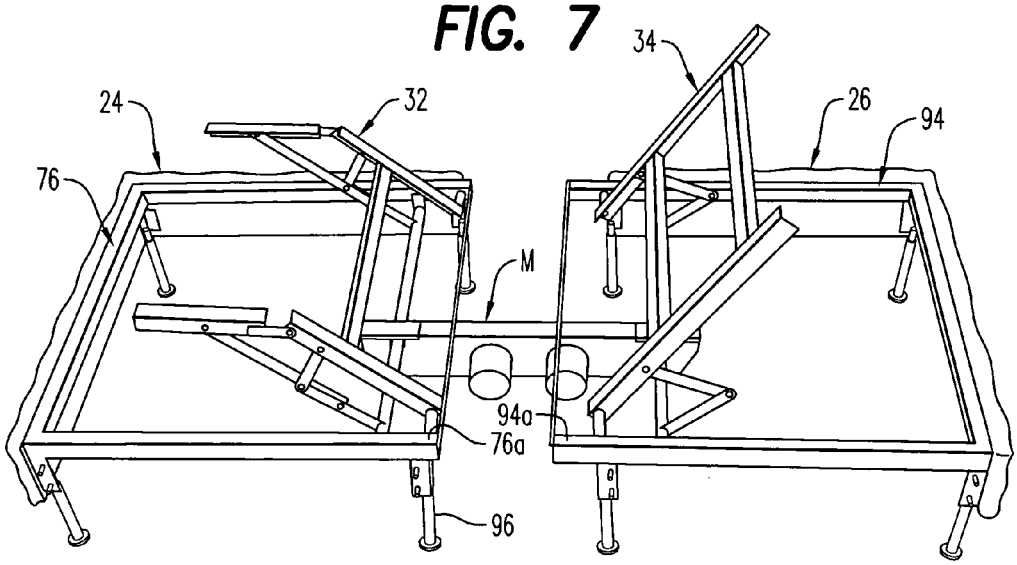
FIG. 7 is a perspective view of the invention showing each of the lifting frames in an upper orientation.
Figure 8:
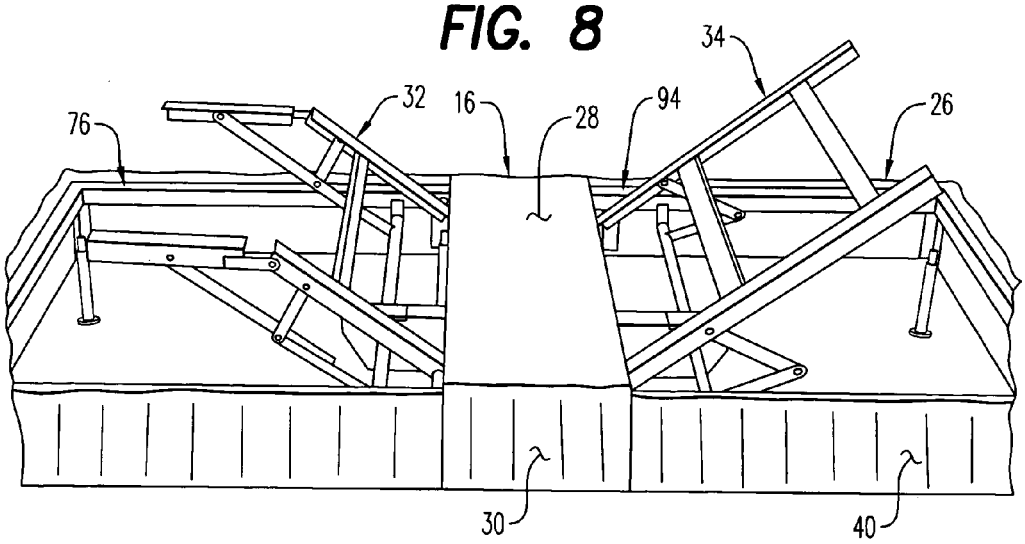
FIG. 8 is a view similar to that of FIG. 7 showing the center support section and all side panels in position.
Figure 9:
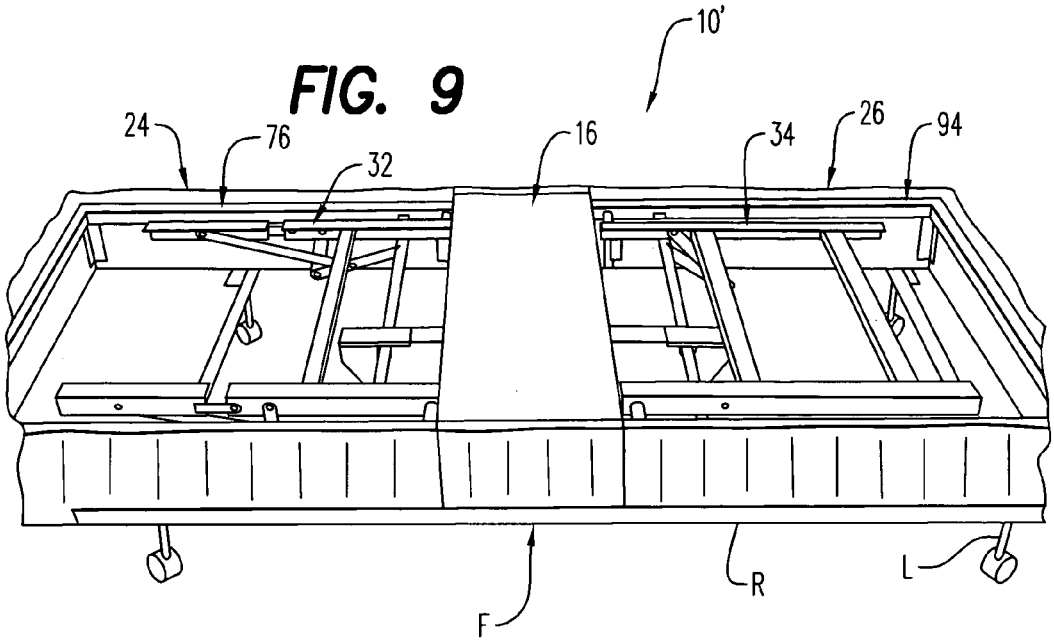
FIG. 9 is a view similar to that of FIG. 8 showing the lifting frames in their downward, flat position.

Referring now to FIGS. 7 to 11, various orientations and stages of assembly are there depicted. In FIG. 7, each of the lifting frames 32 and 34 are shown in an upwardly extended orientation with respect to each of the stationary frames 76 and 94, respectively. In FIG. 8, the same orientation of lifting frames is there shown with the addition of the stationary center section 16 being installed in proper position. FIG. 9, the lifting frames 32 and 34 are in the downward flat position while in FIG. 10, each of the deck panels, i.e. the leg support panels 110 and 112, hinge together along hinge line 111, and the head support deck panel 114 have been attached by mechanical fasteners to each of the respective lifting frames 32 and 34, respectively. In FIG. 11, the entire invention 10' is shown in its fully assembled configuration with each of the lifting frames 32 and 34 in their upwardly deployed orientation with the padded deck panels 110/112 and 114 attached thereto.

Figure 12:
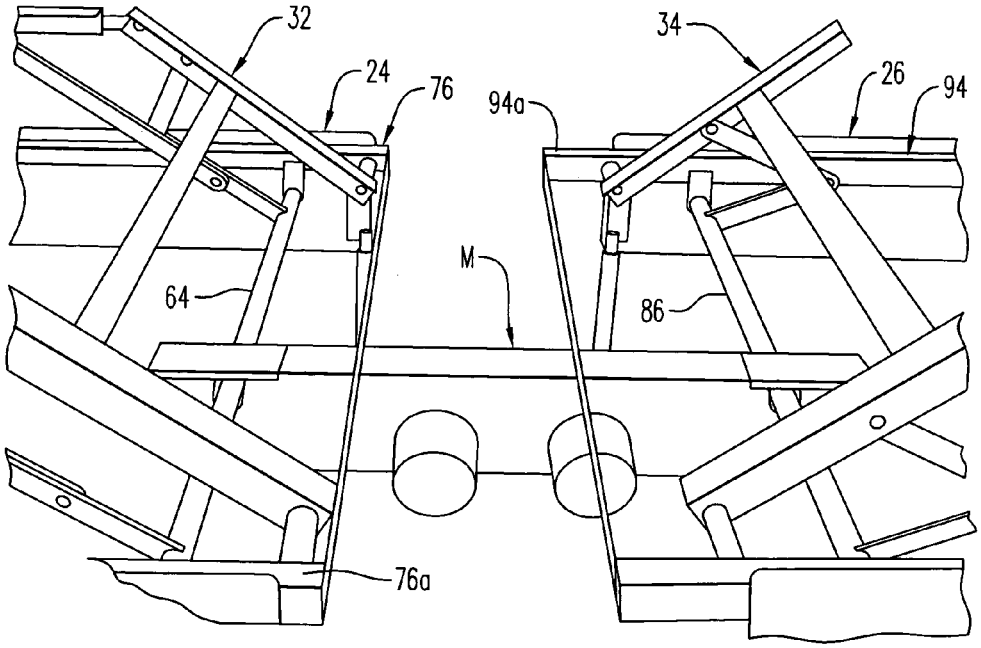
FIG. 12 is an enlarged view of the central portion of the invention absent the center support section and showing the lifting frames in an upper orientation.
Figure 13:
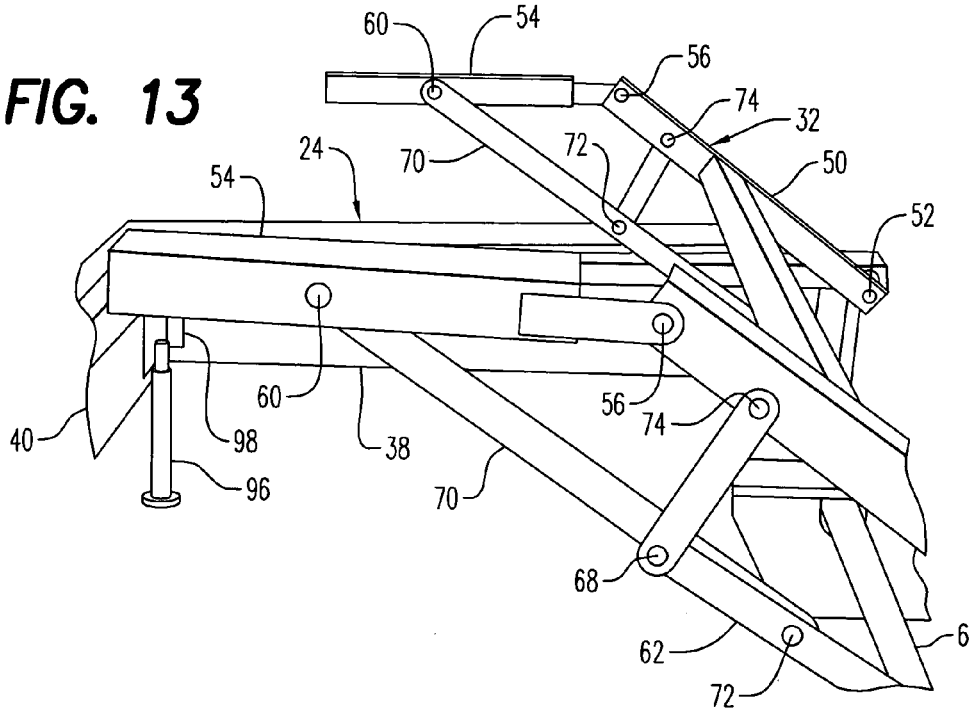
FIG. 13 is an enlarged view of the leg lifting frames of FIG. 12.
Figure 14:
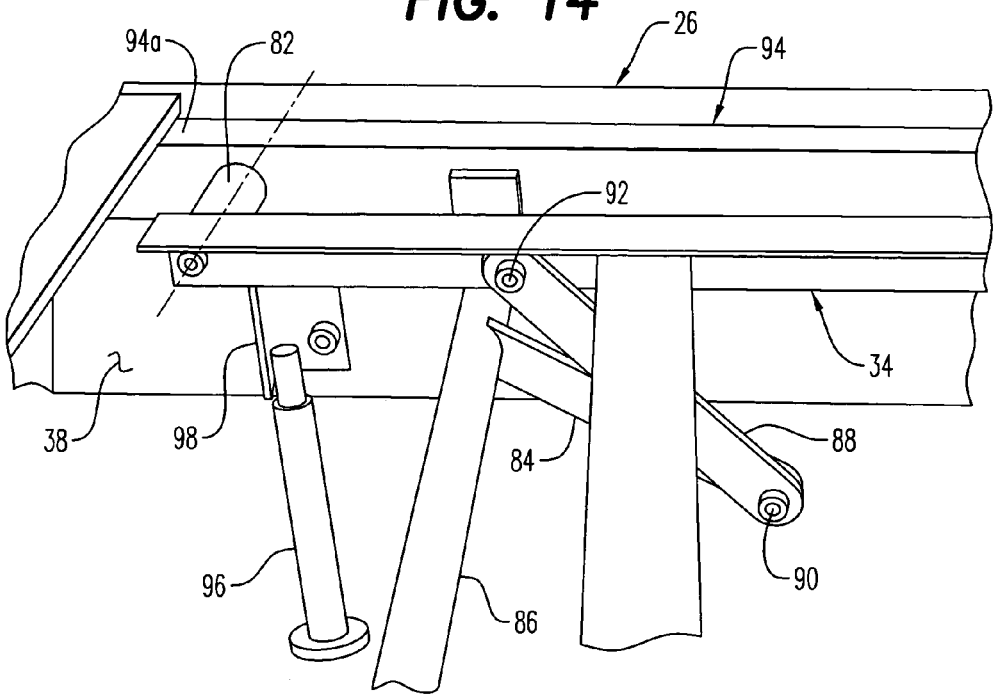
FIG. 14 is an enlarged view of the central portion of one side of the head lifting frame.
Figure 15:
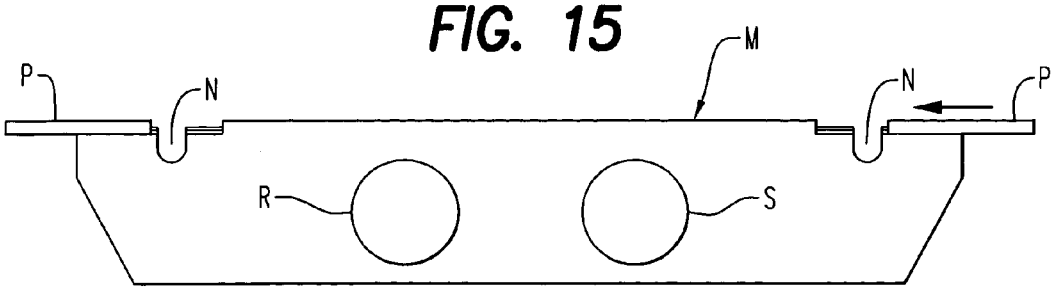
FIG. 15 is a side elevation view of the preferred embodiment of the lifting motor assembly.

Details of the lifting frame assemblies 32 and 34 are shown in FIGS. 12 to 14 while a side elevation view of the preferred embodiment of the motor M is shown in FIG. 15. Attachment of one end of motor M to one of the actuating shafts 64 is shown in FIG. 16 wherein sliding lid P will enclose and retain the actuating shaft 64 in proper position for controlled and powered rotation thereof as described with respect to FIGS. 4 and 5.

The preferred motor is available from Dewart Antriebs- und SystemTechnic GMB and Co. KG of Germany. The Duomat 6 model is preferred although this company offers a Duomat 5 model as well. Another supplier of motors is the Okin Company of Japan under the trademark OKIMAT and OKIMAT 3LI, 3, 2 or other manufacture of line motors.

The actual mattress structure is not shown and is only optionally intended to accompany the invention or be a part thereof as the top mattress may be selected from any commercially available which are suitable for adjustable beds. Likewise, the mattress frame F previously described is also not intended to be a part of this invention which will adapt to virtually any conventional frame support for the box mattress structure or with legs 96 attached, stand alone.

Figure 18:
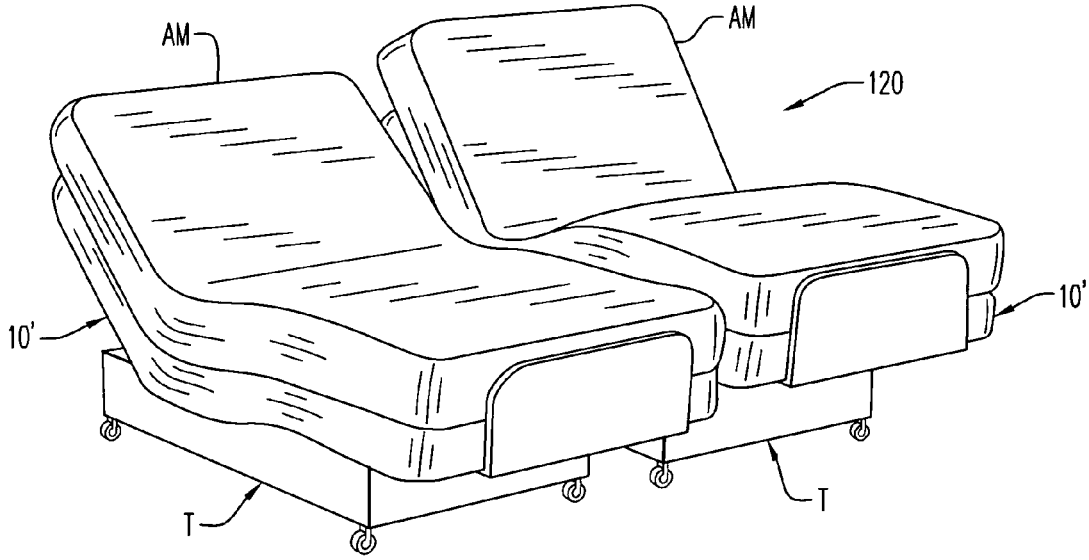
FIG. 18 is a perspective view of two articulated beds 10' atop a foundation, each supporting an articulating mattress AM.

Referring now to FIG. 18, a fully assembled king-size bed is there shown at 120 and includes two side-by-side adjustable articulating beds 10' each supported atop a bed foundation T. An articulating mattress AM is positioned on each of the articulating beds 10' to provide independent adjustability as shown.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. An adjustable articulated bed which supports an articulating mattress, comprising:

a head support assembly having a first stationary perimeter frame pivotally attached to, and supporting a pivotally moveable head lifting frame about a transverse pivotal axis and a deck panel attached atop said head lifting frame for supporting one end of the mattress and for elevating the head and upper body;

a leg support assembly separate from said head support assembly and having a second stationary perimeter frame pivotally attached to, and supporting a pivotally moveable leg lifting frame about a second transverse pivotal axis and two deck panels attached thereatop for supporting another end of the mattress and for elevating the legs;

a stationary center section separate from said support assemblies and having a central panel and downwardly extending side panels, said central panel for supporting a central portion of the mattress and the middle or buttocks area;

said support assemblies and said center section being of equal width and thickness and of a combined length equal to a length of the mattress;

a motor attachable between the leg and head support assemblies properly spacing and locking the assemblies together, said center section snuggly sliding into place therebetween;

each said perimeter frame including side and end panels connected to and downwardly extending from each side and end of each said perimeter frame;

said side and end panels providing an appearance similar to that of a standard bed box spring or platform foundation.

2. An adjustable articulated bed as set forth in claim 1, wherein:

each of said assemblies is within UPS shipping category oversize #2 limits.

3. An adjustable articulated bed as set forth in claim 1, wherein:

each of said assemblies, when packaged and ready for shipment, has a standard bed width of 38" and an overall length and girth of no more than 130".

4. An adjustable articulated bed as set forth in claim 3, wherein:

each of said packaged assemblies has a weight of less than 70 lbs.

5. An adjustable articulated bed which supports an articulating mattress and having a separate motor and two separate body support assemblies, each of which may be shipped separately and assembled by an end user comprising:

an articulating mattress;

a head support assembly including:

a first stationary perimeter frame pivotally attached at a proximal end thereof to, and supporting a separately pivotable generally coextensive head lifting frame about a transverse pivotal axis;

a deck panel attached atop said head lifting frame for supporting one end of the mattress thereatop and for elevating the head and upper body of a user;

a leg support assembly separate from said head support assembly, including:

a second stationary perimeter frame pivotally attached at a proximal end thereof to, and supporting a separately pivotable generally coextensive leg lifting frame about a second transverse pivotal axis;

two edge-to-edge deck panels attached atop said leg lifting frame for supporting another end of the mattress thereatop and for elevating the legs;

a stationary center section separate from said support assemblies and having a central panel and downwardly extending side panels, said central panel for supporting a central portion of the mattress and the middle or buttocks area of the user;

said support assemblies and said center section being of equal width and thickness and of a combined length equal to a length of the mattress;

a motor attachable between the leg and head support assemblies properly spacing and locking the assemblies together, said center section snuggly sliding into place therebetween;

each said perimeter frame including side and end panels connected to and downwardly extending from each side and end of each said perimeter frame;

said side and end panels providing an appearance similar to that of a standard bed box spring or platform foundation.

6. An adjustable articulated bed as set forth in claim 5, wherein:

each of said assemblies is within UPS shipping category oversize #2 limits.

7. An adjustable articulated bed as set forth in claim 5, wherein:

each of said assemblies, when packaged and ready for shipment, has a standard bed width of 38" and an overall length and girth of no more than 130".

8. An adjustable articulated bed as set forth in claim 5, wherein:

each of said packaged assemblies has a weight of less than 70 lbs.

9. An adjustable articulated bed which supports an articulating mattress, comprising:

a head support assembly having a first stationary perimeter frame pivotally attached to, and supporting a pivotally moveable head lifting frame about a transverse pivotal axis and a mattress supporting first deck panel attached atop said head lifting frame for elevating the head and upper body;

a leg support assembly separate from said head support assembly and having a second stationary perimeter frame pivotally attached to, and supporting a pivotally moveable leg lifting frame about a second transverse pivotal axis and second and third mattress supporting deck panels attached thereatop for elevating the legs;

a stationary center section separate from said support assemblies and having a central deck panel and downwardly extending side panels, said central deck panel for supporting the middle or buttocks area;

said support assemblies and said center section being of equal thickness and of a combined length equal to a length of the mattress;

a motor attachable between the leg and head support assemblies which, when attached therebetween, spacing and locking the assemblies together, said center section snuggly held in place therebetween;

each said perimeter frame including side and end panels connected to and downwardly extending from each side and end of each said perimeter frame;

said side and end panels providing an appearance similar to that of a standard bed box spring or platform foundation.

10. An adjustable articulated bed as set forth in claim 9, wherein:

each of said assemblies is within UPS shipping category oversize #2 limits.

11. An adjustable articulated bed as set forth in claim 9, wherein:

each of said assemblies, when packaged and ready for shipment, has a standard bed width of 38" and an overall length and girth of no more than 130".

12. An adjustable articulated bed as set forth in claim 9, wherein:

each of said packaged assemblies has a weight of less than 70 lbs.

* * * * *